US010808467B1

(12) United States Patent
Haley

(10) Patent No.: US 10,808,467 B1
(45) Date of Patent: Oct. 20, 2020

(54) RETRACTABLE TUBULAR HOLDBACK LINE SYSTEM AND METHOD

(71) Applicant: Kye M Haley, Calgary (CA)

(72) Inventor: Kye M Haley, Calgary (CA)

( * ) Notice: Subject to any disclaimer, the term of this patent is extended or adjusted under 35 U.S.C. 154(b) by 0 days.

(21) Appl. No.: 16/656,654

(22) Filed: Oct. 18, 2019

(51) Int. Cl.
*E21B 19/15* (2006.01)

(52) U.S. Cl.
CPC ..... *E21B 19/155* (2013.01)

(58) Field of Classification Search
CPC ..... E21B 19/155; E21B 19/15; E21B 19/14; E21B 19/20
USPC ..... 414/22.51–22.71; 175/85
See application file for complete search history.

(56) References Cited

U.S. PATENT DOCUMENTS 2,692,059 A * 10/1954 Bolling, Jr. ..... E21B 19/14 414/22.51
3,229,960 A 1/1966 Loomis
3,404,741 A 10/1968 Aldea
4,098,532 A 7/1978 Phillips
4,172,684 A * 10/1979 Jenkins ..... E21B 19/14 175/85
4,274,778 A * 6/1981 Putnam ..... B25J 9/0084 175/85
5,711,382 A 1/1998 Hansen
8,028,748 B2 * 10/2011 Laitolais, Jr. ..... E21B 41/0021 166/77.51
8,839,881 B1 * 9/2014 Baumler ..... E21B 19/155 175/85
2011/0188973 A1 * 8/2011 Baumler ..... E21B 19/08 414/22.57
2014/0338973 A1 11/2014 Taylor
2015/0176349 A1 * 6/2015 Belik ..... E21B 19/16 285/27
2017/0314347 A1 * 11/2017 Barnes ..... E21B 19/161

FOREIGN PATENT DOCUMENTS

CA 2578027 * 1/2011
CA 2538625 * 8/2012
CA 2864939 * 8/2013
CN 1450246 * 10/2003
CN 104389532 * 3/2015
CN 103485735 * 2/2016
CN 104405302 * 2/2017

* cited by examiner

*Primary Examiner* — Lynn E Schwenning
(74) *Attorney, Agent, or Firm* — Runyan Law; Charles Runyan

(57) ABSTRACT

A retractable tubular holdback system and method; the retractable tubular holdback line system includes a bi-directional motor, a cable spool, a cable, releasable coupler, an interface coupled to the bi-directional motor and configured to be couplable to the first vee-door guide post and a reversible power input control system. The power input control system may be configured to actuate the bi-directional motor at a governed rate of speed. The retractable tubular holdback line system is useful for providing a safe retractable biasing tether means couplable to the first vee-door guide post and the second vee-door guide post of a drilling rig to catch and control the tail-swing of a drill pipe section from the vee-door to a drilling platform.

20 Claims, 5 Drawing Sheets

RETRACTABLE TUBULAR HOLDBACK LINE SYSTEM AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of material or article handling of existing art and more specifically relates to wellbore tubular running systems; tubular handling.

RELATED ART

The vee-door is an opening at the floor level in one side of the derrick and is located on the rig floor opposite to the draw works. A slide-like ramp is used to pick up and lay down tools to and from the catwalk/pipe rack area. Lifting systems may be used to pick up drill pipe, drill collars or any other heavy equipment. This must be done safely because of the height of the substructure and close proximity to the blowout preventers, electric and hydraulic lines, and other equipment in the area.

Conventional art oil field pipe handling systems are used to lower drill pipe and casing to and from pipe racks, to and from the catwalk, and then onto the rig floor, and/or used for stacking the pipe at other locations adjacent to or separated from the rig floor. However, these systems have problems relating to damage of the tubulars during this process. Moreover, systems are limited in their adaptability to the path of transportation to and from each particular rig floor, catwalk, and pipe rack arrangement. A suitable solution is desired whereby a reliable means is provided for moving pipes, casings or tools, as they arrive at the rig floor without experiencing sharp lateral movement as it passes through the vee-door and swings across the floor causing impacts and/or friction damage to sensitive areas such as threads.

U.S. Pat. No. 4,098,532 to William H. Phillips relates to a quick engage and release sling for tubular members. The described quick engage and release sling for tubular members includes a pipe lay down machine which incorporates a main cable adapted to be rigged from the rig floor to a winch overlying a pipe rack where the winch is bidirectionally operable to slack the main line. Wheeled carriages travel up and down the main line. The carriages support releasable pipe connective mechanisms which have a flexible cable extending around the pipe connected to a quick release mechanism. The quick release mechanism includes a transverse bar having protruding ears or tabs which interlock with a rolled lip, thereby anchoring the lever and the end of the cable. Pipe is picked up or laid down by placing slack in the main cable. Alternative quick release mechanisms are disclosed. In one form, a cable is looped about the pipe and beneath a spring load pin. The pin is pushed to close and cable tension holds it closed. The delivery of the pipe to the destination is accompanied by slacking the cable whereupon the spring-loaded pin is withdrawn and releases the cable. A very desirable alternative device is a hook having an arm appended to it. The arm is easily handled and the hook reaches over a cable or rope looped around a pipe to be lifted.

SUMMARY OF THE INVENTION

In view of the foregoing disadvantages inherent in the known wellbore tubular running systems; tubular handling art, the present disclosure provides a novel retractable tubular holdback system and method. The general purpose of the present disclosure, which will be described subsequently in greater detail, is to provide an efficient and effective retractable tubular holdback system.

The present invention looks to provide a safe system which will handle all types of pipes and which adapt to the vee-door pathways, to control lateral movement of tubulars from vee-door across the rig floor without damage even to extremely heavy, large, tubulars and/or to other tubulars prone to damage due to sharp lateral impacts or impacts to the sensitive threaded ends and, more importantly reduce injuries to workers.

A retractable tubular holdback line system is disclosed herein. The retractable tubular holdback line system includes a bi-directional motor; the bi-directional motor configured to be coupled to a cable spool, and a cable. The cable is coupled to the cable spool at a first end having a releasable coupler at a second end. The system may be configured to provide a biasing tether between a first vee-door guide post and a second vee-door guide post. Further included is an interface coupled to the bi-directional motor and configured to be couplable to the first vee-door guide post, a reversible power input control system; the power input control system configured to actuate the bi-directional motor at a governed rate of speed. The retractable tubular holdback line system may be configured to provide a safe retractable biasing tether(ing) means couplable to the first vee-door guide post and the second vee-door guide post of a drilling rig to catch and control the tail-swing of a drill pipe section from the vee-door to a drilling platform.

According to another embodiment, a method of use is also disclosed herein. The method of use includes the steps of providing a retractable tubular holdback line system, coupling, attaching, connecting, actuating, and a disconnecting step.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a retractable tubular holdback line system and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to wellbore tubular running systems; tubular handling and more particularly to a retractable tubular holdback line system and method as used to improve the safety and efficiency of drilling processes.

The retractable tubular holdback line system, as disclosed herein, is needed to decrease occurrences of hand & back injuries when hoisting tubulars to the rig floor using conventional means. This replaces the use of a rope and hand(s) to bring tubulars to the rig floor, since the retractable rope or strap will hold back tubular weight & let out the line for the user (to a certain point where then it is safe to use hands). Once dropped below the tubular the device then automatically retracts to its original position.

Referring now more specifically to the drawings by numerals of reference, there is shown in FIGS. 1-4, various views of a retractable tubular holdback line system 100.

Figure 1:
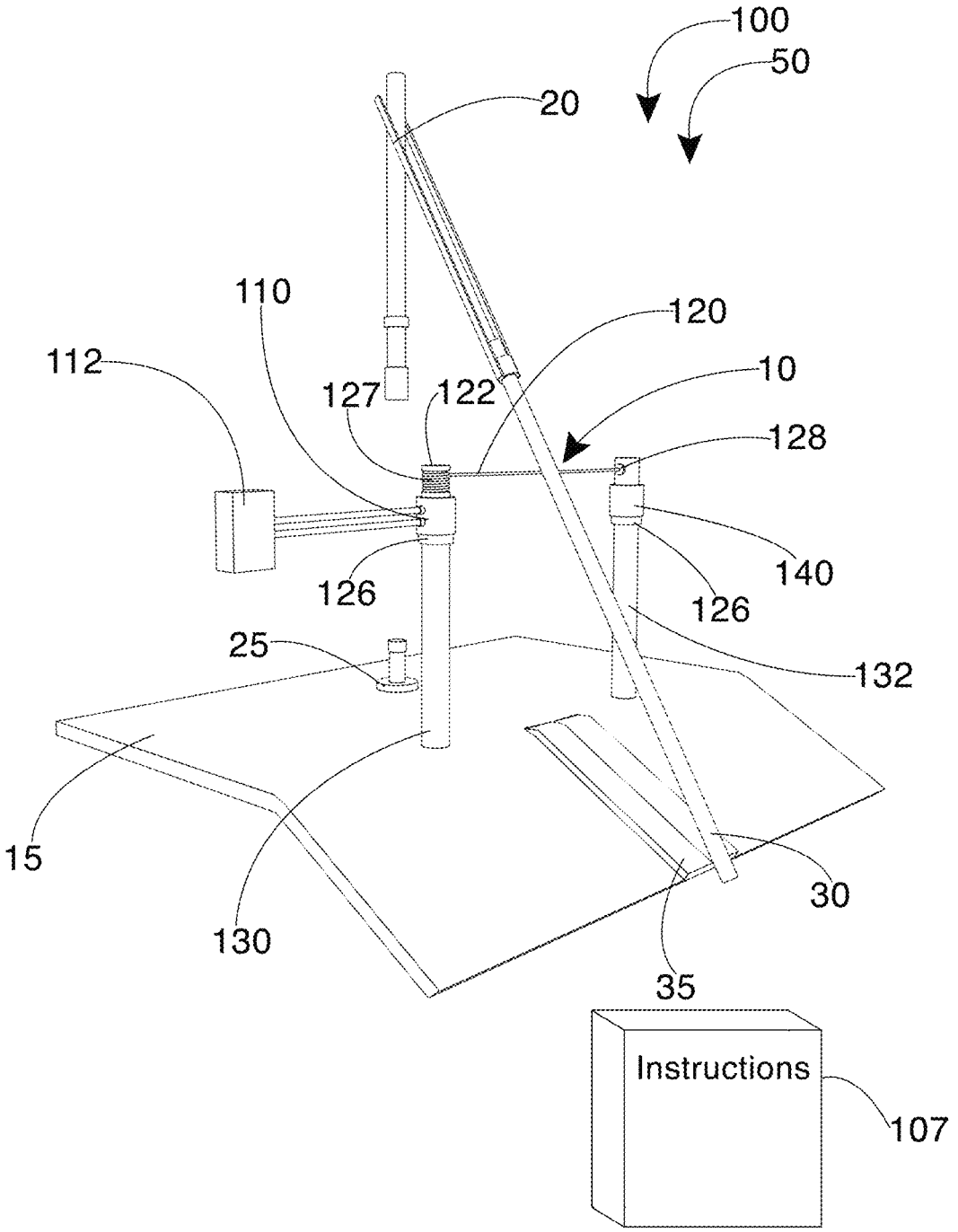
FIG. 1 is a front view of the retractable tubular holdback line system during an 'in-use' condition, according to an embodiment of the disclosure.
Figure 2:
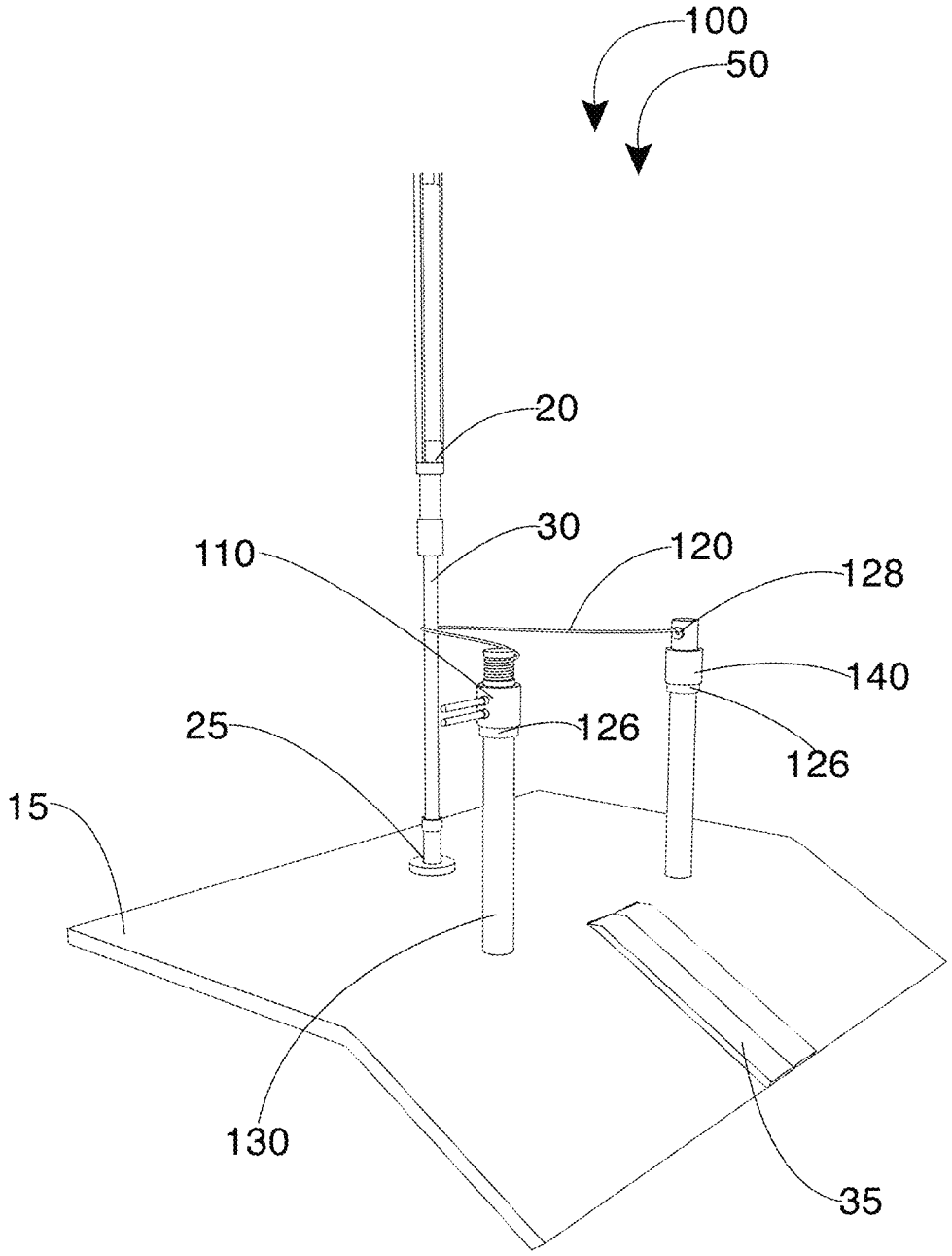
FIG. 2 is a perspective view of the retractable tubular holdback line system of FIG. 1, according to an embodiment of the present disclosure.

FIGS. 1 & 2 shows a retractable tubular holdback line system 100 during an 'in-use' condition 50, according to an embodiment of the present disclosure. Here, the retractable tubular holdback line system 100 may be beneficial for use by a user 40 for coupling to a vee-door 10 on a drilling rig 20. When used it controls the lateral swing of a section of drill pipe 30, tools or equipment from the vee-door 10 across the drill rig platform 15 to its preferred location while further providing a means of reducing personal injury to workers and impact damage to sensitive areas of tools and equipment. As illustrated, the retractable tubular holdback line system 100 may include a bi-directional motor 110; the bi-directional motor 110 may be configured to be coupled to a cable spool 122. The cable spool 122 has sufficient storage for winding and unwinding the cable 120 therefrom. What is preferred is storage of a length of cable 120 at least twice the distance from the vee-door 10 to the table 25. The cable 120 is coupled to the cable spool 122 at a first end 127 and may also include a releasable coupler 126 at a second end 128.

The system 100 may be configured to provide a biasing tether means between a first vee-door guide post 130 and a second vee-door guide post 132. As shown in FIGS. 1 & 2 the retractable biasing tether provides a means for controlling the free end of a section of drill pipe 30 during tripping operations from the vee-door 10 across the table 25 to be added or removed to/from the drill string, eliminating the need for a worker to manually handle the section of drill pipe 30 and risking personal injury.

An interface 140 which is preferably coupled to the bi-directional motor 110 may be configured to be couplable to the first vee-door guide post 130. Additionally, a reversible power input control 112 system may be configured to actuate the bi-directional motor 110 at a governed rate of speed to extend the cable 120 tether and further retract the cable 120 to capture the next section of drill pipe 30 while tripping in or return the free end of the drill pipe 30 to the beaver slide 35 when tripping out.

Still referring to FIGS. 1 & 2 a retractable tubular holdback line system 100 may be configured to provide a safe retractable biasing tether means couplable to the first vee-door guide post 130 and the second vee-door guide post 132 of the drilling rig 20 to catch and control the tail-swing of a drill pipe 30 section from the vee-door 10 onto or across a drilling platform 15.

In an embodiment of the present invention the bi-directional motor 110 may be a hydraulic motor; the bi-directional motor 110 may further include a spool-housing and a cable guide (not shown). The interface 140 is coupled to the bi-directional motor 110 and may be configured to be couplable to the first vee-door guide post 130. The interface 140, as shown, is a collar configured to slide over an outer periphery of the first vee-door guide post 130 and held in place preferably with a treaded fastener 142. A releasable coupler 126 at a second end 128 of the cable 120 is configured to slide over an outer periphery of the second vee-door guide post 132. And may also be held in place with a treaded fastener 142.

According to one embodiment, the retractable tubular holdback line system 100 may be arranged as a kit 105. In particular, the retractable tubular holdback line system 100 may further include a set of instructions 107. The instructions 107 may detail functional relationships in relation to the structure of the retractable tubular holdback line system 100 such that the retractable tubular holdback line system 100 can be used, maintained, or the like, in a preferred manner.

Figure 3:
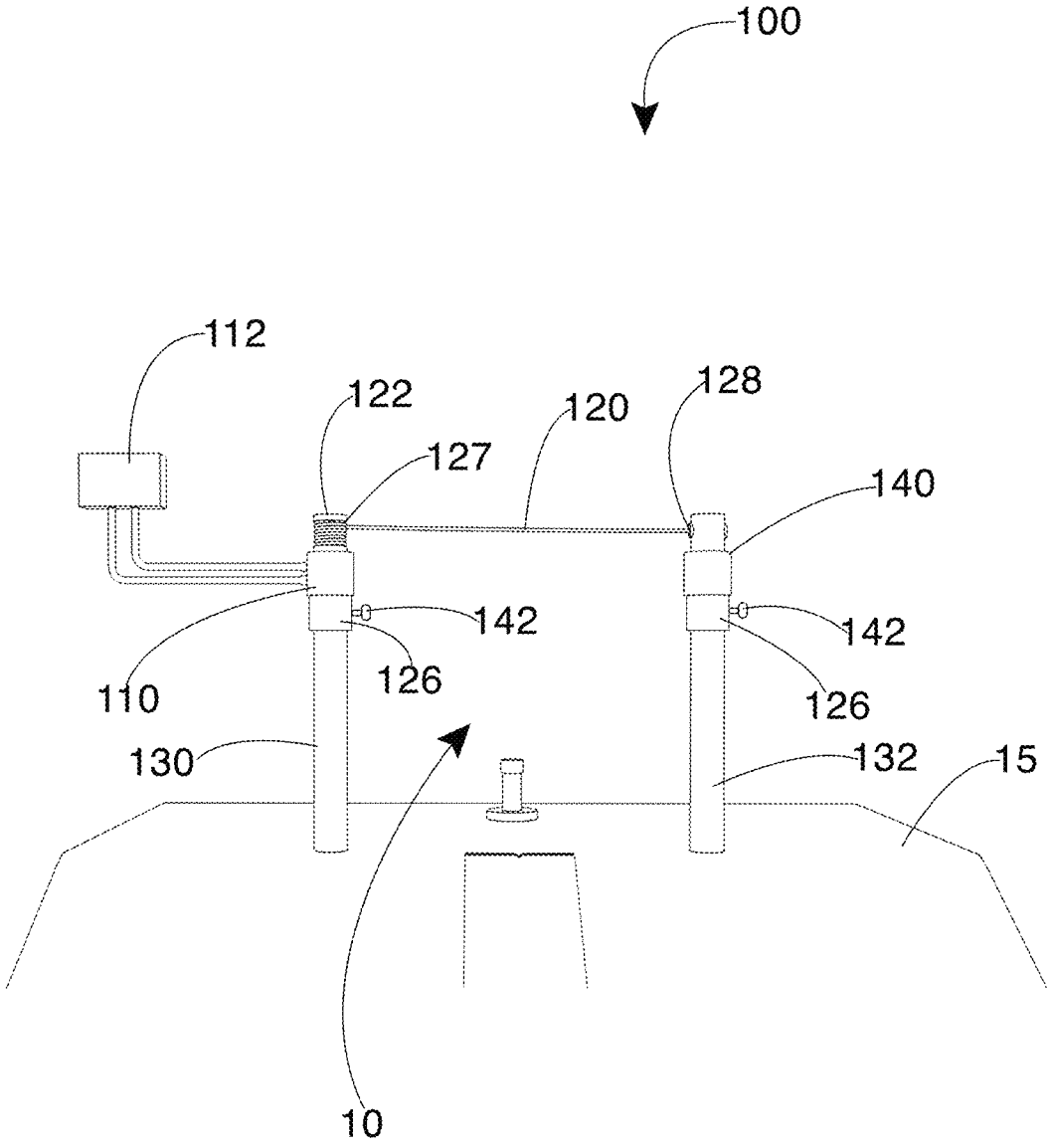
FIG. 3 is a front view of the retractable tubular holdback line system of FIG. 1, according to an embodiment of the present disclosure.

Referring now to FIG. 3 showing a front view of the retractable tubular holdback line system 100 of FIG. 1, according to an embodiment of the present disclosure. The bi-directional motor 110 may be defined as a hydraulic motor, as previously mentioned. Further the reversible power input control 112 system may comprise a valve module coupled to the hydraulic motor and the hydraulic system of the drilling rig 20.

In still other embodiments of the present disclosure the bi-directional motor 110 may be defined as an electric motor having a reversible power input control 112 system which includes an electric power resister and polarity converter coupled to a generating system of the drilling rig 20. It may be further understood that the reversible power input control 112 system may include an electric power resister and polarity converter coupled to a portable generator. Other examples may include but not be limited to a pneumatic motor including a reversible power input control 112 system that may be a valve module coupled to a compressed air system of the drilling rig 20 or a biasing spring hydraulic piston.

Figure 4:
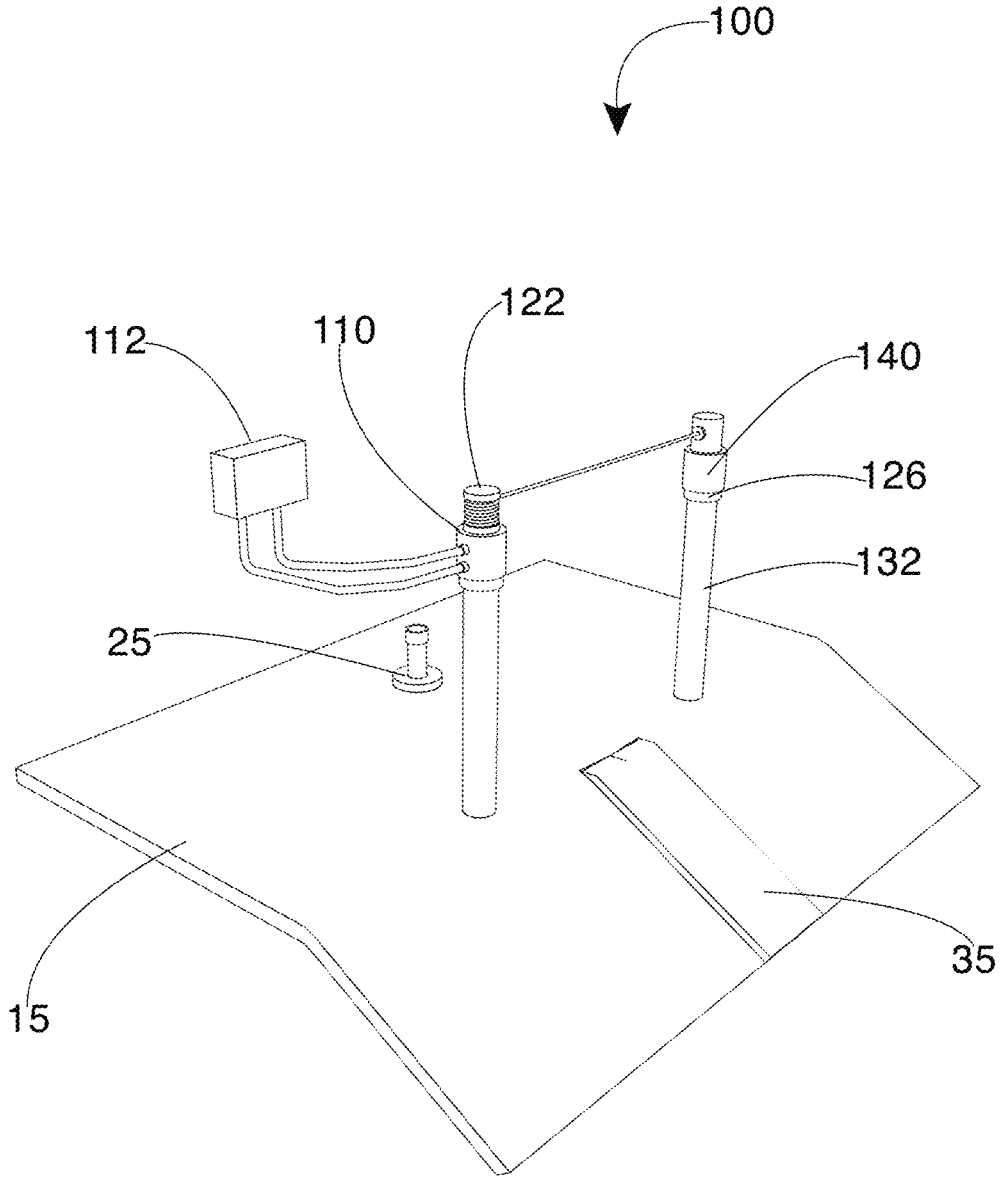
FIG. 4 is a perspective view of the retractable tubular holdback line system of FIG. 1, according to an embodiment of the present disclosure.

FIG. 4 is a perspective view of the retractable tubular holdback line system 100 of FIG. 1, according to an embodiment of the present disclosure the cable 120 may be made of steel wire rope or any other material having sufficient tensile strength to bear the weight and force applied by the drill pipe 30 section. Although not shown, an embodiment may include bi-directional motor 110 further including a spool housing and a cable guide of cable 120.

Additionally, the interface 140 is coupled to the bi-directional motor 110 being configured to be couplable to the first vee-door guide post 130 which may be a steel plate held in place with U-bolt fasteners or the like. As shown in FIG. 4 an embodiment of the present disclosure the interface 140 may be weldable to the first vee-door guide post 130. Alternatively, as stated above the interface 140, coupled to the bi-directional motor 110 and configured to be couplable to the first vee-door guide post 130 may be a collar configured to slide over an outer periphery of the first vee-door guide post 130 and held in place with a treaded fastener 142. It should be noted that in an embodiment of the present disclosure the releasable coupler 126 at the second end 128 of the cable 120 may comprise a loop configured to slide over an outer periphery if the second vee-door guide post 132.

Figure 5:
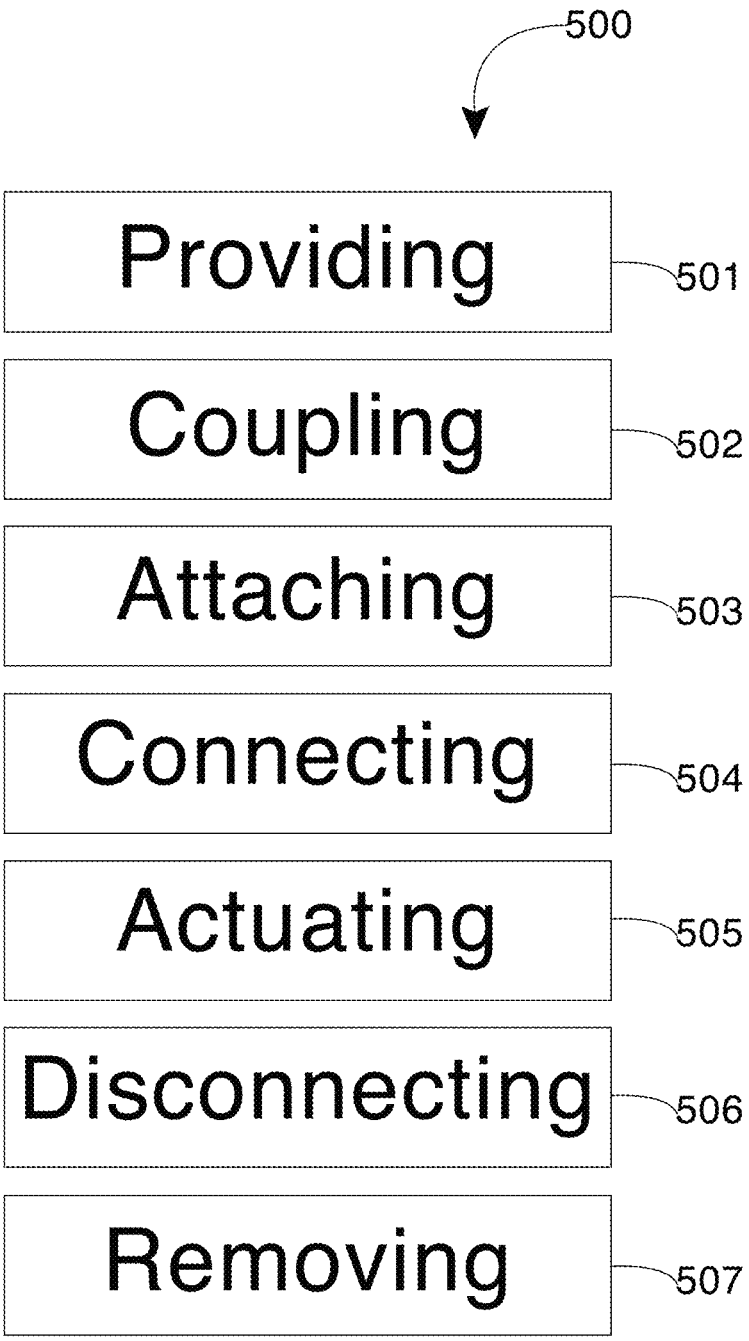
FIG. 5 is a flow diagram illustrating a method of use for the retractable tubular holdback line system, according to an embodiment of the present disclosure.

Referring now to FIG. 5, a flow diagram illustrating a method for use 500 for the retractable tubular holdback line system 100, according to an embodiment of the present disclosure. In particular, the method for using 500 the retractable tubular holdback line system 100 may include one or more components or features of the retractable tubular holdback line system 100 as described above. As illustrated, the method of use 500 for a retractable tubular holdback line system 100 may include the steps of: step one 501, providing a retractable tubular holdback line system 100; the system 100 comprising a bi-directional motor 110; the bi-directional motor 110 configured to be coupled to cable spool 122, and a cable 120; the cable 120 coupled to the cable spool 122 at a first end 127 having a releasable coupler 126 at a second end 128; and configured to provide a biasing tether between a first vee-door guide post 130 and a second vee-door guide post 132, an interface 140 coupled to the bi-directional motor 110 and configured to be couplable to the first vee-door guide post 130, a reversible power input control 122 system; the power input control 122 system configured to actuate the bi-directional motor 110 at a governed rate of speed. The retractable tubular holdback line system 100 is configured to provide a safe retractable biasing tether means couplable to the first vee-door guide post 130 and the second vee-door guide post 132 of the drilling rig 20 to catch and control the tail-swing of a drill pipe 30 section from the vee-door 10 to a drilling platform 15; step two 502, coupling the retractable tubular holdback line system 100 to the first vee-door guide post 130; step three 503, attaching the releasable coupler 126 to the second vee-door guide post 132; step four 504, connecting to a hydraulic system (or the like); step five 505, actuating reversible power input control system; step six 506, disconnecting the releasable coupler 126 and step seven 507, removing the retractable tubular holdback line system 100.

It should be noted that step 507 is an optional step and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for use of the retractable tubular holdback line system are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A retractable tubular holdback line system, for coupling to a vee-door on a drilling rig, the system comprising:

a bi-directional motor the bi-directional motor configured to be coupled to a cable spool;

a cable, the cable coupled to the cable spool at a first end having a releasable coupler at a second end;

said system configured to provide a biasing tether between a first vee-door guide post and a second vee-door guide post;

an interface coupled to the bi-directional motor and configured to be couplable to the first vee-door guide post; and a reversible power input control system, the power input control system configured to actuate said bi-directional motor at a governed rate of speed;

wherein the retractable tubular holdback line system is configured to provide a safe retractable biasing tether means couplable to the first vee-door guide post and the second vee-door guide post of the drilling rig to catch and control the tail-swing of a drill pipe section from the vee-door to a drilling platform.

2. The system of claim 1, wherein the bi-directional motor is an electric motor.

3. The system of claim 1, wherein the bi-directional motor is a hydraulic motor.

4. The system of claim 1, wherein the wherein the bi-directional motor is a pneumatic motor.

5. The system of claim 1, wherein the bi-directional motor is a biasing spring hydraulic piston.

6. The system of claim 1, wherein the cable is a steel wire rope.

7. The system of claim 1, wherein the cable is made of a material having sufficient tensile strength to bear weight and force applied by the drill pipe section.

8. The system of claim 1, wherein the bi-directional motor further includes a spool housing.

9. The system of claim 8, wherein the spool-housing includes a cable guide.

10. The system of claim 1, wherein the interface is coupled to the bi-directional motor and is configured to be couplable to the first vee-door guide post and is weldable to the first vee-door guide post.

11. The system of claim 1, wherein the interface is coupled to the bi-directional motor and configured to be couplable to the first vee-door guide post, and wherein the interface is a collar configured to slide over an outer periphery of the first vee-door guide post and is held in place with a treaded fastener.

12. The system of claim 2, wherein the reversible power input control system includes an electric power resister and a polarity controller coupled to a generating system of the drilling rig.

13. The system of claim 12, wherein the reversible power input control system includes an electric power resister coupled to a portable generator.

14. The system of claim 3, wherein the reversible power input control system is a valve module coupled to the hydraulic motor and a hydraulic system of the drilling rig.

15. The system of claim 4, wherein the reversible power input control system is a valve module coupled to a compressed air system of the drilling rig.

16. The system of claim 1, wherein the releasable coupler at the second end of the cable is a loop configured to slide over an outer periphery of the second vee-door guide post.

17. A retractable tubular holdback line system, the system comprising:

a bi-directional motor, the bi-directional motor configured to be coupled to cable spool;

a cable, the cable coupled to said cable spool at a first end having a releasable coupler at a second end; and the system configured to provide a biasing tether means between a first vee-door guide post and a second vee-door guide post;

an interface coupled to the bi-directional motor and configured to be couplable to the first vee-door guide post;

a reversible power input control system, the power input control system configured to actuate said bi-directional motor at a governed rate of speed;

wherein the retractable tubular holdback line system is configured to provide a safe retractable biasing tether means couplable to the first vee-door guide post and the second vee-door guide post of the drilling rig to catch and control the tail-swing of a drill pipe section from the vee-door to a drilling platform;

wherein the bi-directional motor is a hydraulic motor;

wherein the bi-directional motor further includes a spool-housing;

wherein the spool-housing includes a cable guide;

wherein the interface is coupled to the bi-directional motor and is configured to be couplable to the first vee-door guide post, and wherein the interface is a collar configured to slide over an outer periphery of the first vee-door guide post and held in place with a treaded fastener; and wherein the releasable coupler at a second end of the cable is a loop configured to slide over an outer periphery of the second vee-door guide post.

18. The retractable tubular holdback line system of claim 17, further comprising set of instructions; and wherein the retractable tubular holdback line system is arranged as a kit.

19. A method of use for a retractable tubular holdback line system, the method comprising the steps of:

providing a retractable tubular holdback line system, the system comprising:

a bi-directional motor the bi-directional motor configured to be coupled to cable spool;

a cable, the cable coupled to said cable spool at a first end having a releasable coupler at a second end; and configured to provide a biasing tether between a first vee-door guide post and a second vee-door guide post;

an interface coupled to the bi-directional motor and configured to be couplable to the first vee-door guide post;

a reversible power input control system, the power input control system configured to actuate said bi-directional motor at a governed rate of speed;

wherein the retractable tubular holdback line system is configured to provide a safe retractable biasing tether means couplable to the first vee-door guide post and the second vee-door guide post of the drilling rig to catch and control the tail-swing of a drill pipe section from the vee-door to a drilling platform;

coupling the retractable tubular holdback line system to the first vee-door guide post;

attaching the releasable coupler to the second vee-door guide post;

connecting to a hydraulic system; and actuating the reversible power input control system.

20. The method of claim 19, further comprising the step of:

disconnecting the releasable coupler; and removing the retractable tubular holdback line system.

* * * * *